United States Patent [19]

Hahn

[11] Patent Number: 4,502,256

[45] Date of Patent: Mar. 5, 1985

[54] ARRANGEMENT FOR SECURING A FLEXIBLE WEB TO A WALLING MEANS

[75] Inventor: Ralf Hahn, Michelstadt/Odenwald, Fed. Rep. of Germany

[73] Assignee: Veith Pirelli, A.G., Hochst/Odenwald, Fed. Rep. of Germany

[21] Appl. No.: 339,614

[22] Filed: Jan. 15, 1982

[30] Foreign Application Priority Data

Jan. 23, 1981 [DE] Fed. Rep. of Germany ..... 3102201
Apr. 9, 1981 [DE] Fed. Rep. of Germany ..... 3134973

[51] Int. Cl.[3] ..... E04B 1/12

[52] U.S. Cl. ..... 52/63; 52/506; 52/512; 24/459

[58] Field of Search ..... 52/512, 506, 63, 408, 52/511, 127.7, 127.12, 395, 461, 469, 222, 273; 160/383, 399, 402, 401, 403; 135/119; 24/201 C, 243 K, 671, 676, 679, 691, 459, 90 CE, 92

[56] References Cited

U.S. PATENT DOCUMENTS 4,221,028 9/1980 Fischer ..... 24/459

FOREIGN PATENT DOCUMENTS 2400140 7/1975 Fed. Rep. of Germany ..... 52/506
341960 12/1959 Switzerland ..... 135/119

*Primary Examiner*—Carl D. Friedman
*Attorney, Agent, or Firm*—Michael L. Dunn; Howard M. Ellis

[57] ABSTRACT

Described is an arrangement for securing a water-impervious flexible web (10) comprising an elastomer on a walling means (6) to be sealed, in particular a flat roof, having a holder member (1) which can be secured to the walling means (6) and which has a projection (5) with an outwardly projecting side bead (7) forming an undercut configuration (8), and an outer securing member (11), with the web (10) being arranged to be clamped between the holder member (1) and the outer securing member (11).

In order to avoid the disadvantageous formation of folds, to prevent damage to the flexible web, and also to prevent the spring ring from slipping out of place, while also achieving a higher degree of fixing stability than in known arrangements of this kind, while using simple means, the arrangement provides that the outer securing member (11) has, as one piece, a plate-shaped resilient spring plate (12) which is at least partially engaged by an elastomer or plastomer material, and a clamp means (13) which is enclosed on all sides by an elastomer or plastomer material, forming a resiliently yielding cushion means (16) arranged in relation to the flexible web (10).

13 Claims, 21 Drawing Figures

Figure 1:
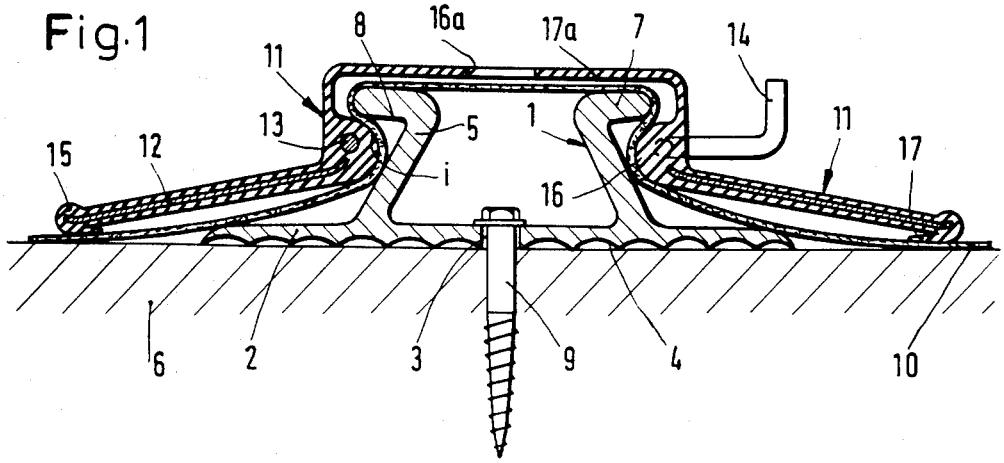

Fig. 20
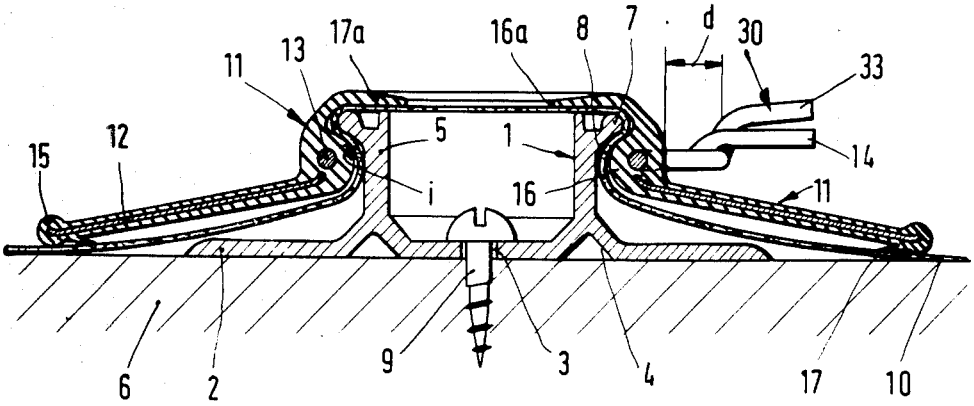
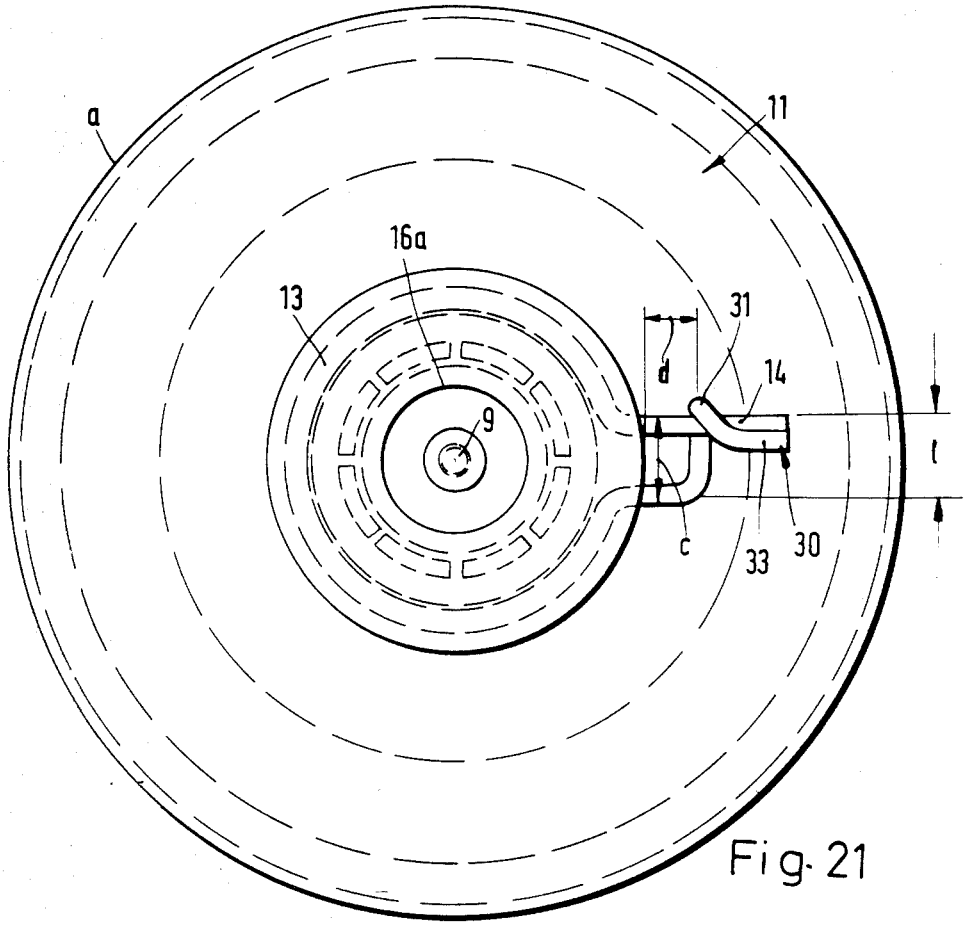
Fig. 21

ARRANGEMENT FOR SECURING A FLEXIBLE WEB TO A WALLING MEANS

The invention relates to an arrangement for securing a water-impervious, flexible web of an elastomer material to a walling means to be sealed off, in particular a flat roof, comprising a holder member which can be fixed to the walling means and which has a projection with an outwardly projecting side bead forming an undercut configuration, and an outer securing member, wherein the web can be clamped fast between the holder member and the outer securing member.

An arrangement of the above-described kind is known, for sealing roof surfaces. The water-impervious flexible web in that arrangement is a roof sheathing which preferably comprises rubber. Such roof sheathings are highly resistant to weathering influences and are also mechanically strong to a certain extent, so that they are particularly suitable for sealing roofs of widely varying kinds, in particular flat concrete roofs.

The fixings have caused difficulties in connection with such arrangements; for it is undesirable for such a flexible web, that is to say, a rubber roof sheathing, to be secured to the sub-structure, that is to say, the walling means which is to be sealed off, by means which are passed through the roof sheathing. In spite of seals being provided at such locations, precipitation would repeatedly penetrate through the roof sheathing so that there is no possibility of cutting, piercing, boring or performing like operations on the roof sheathing, for the purposes of securing the flexible web.

A two-part clamping means has therefore been developed, comprising a holder member which can be fixed directly to the walling and which can be fixed directly to the walling and which can be secured for example by screws directly to the walling structure in question. The holder member or inner clamping member projects high upwardly in the form of a projection from the walling arrangement and, at a spacing therefrom, has a side bead which extends around the holder member and which projects in the direction in which the walling means extends. This arrangement provides a kind of mushroom shape in cross-section, with the above-mentioned undercut configuration being disposed at the upper end of the stem of the mushroom. After the holder member has been secured in place, the flexible web is laid onto the walling means surface and over the holder member. The holder members are arranged at various spacings on the walling means so that the flexible web is sufficiently secured at the locations of the holder members.

The flexible web is now secured in position by an open steel spring ring being slipped over the holder member, with the spring ring being slightly opened up in order to facilitate the fitting operation. After the spring ring has been pushed over the side bead on the holder member, the bending force is removed so that, due to its inherent resiliency, the spring ring pulls the flexible web which is disposed between the holder member and the ring, around the surface of the mushroom shape and into the undercut configuration. This produces a certain detent effect and the roof sheathing is fixed in place.

The influences of weather, in particular wind and fluctuations in temperature, can occasionally cause the known mechanical fixing for the flexible web to become loose because it is only the clamping force of the spring ring which serves to hold the flexible web in place. In addition, the spring ring may suffer from fatigue phenomena due to the considerable fluctuations in weather.

In addition, when a roof sheathing is clamped in position in the above-described manner, the roof sheathing is frequently folded and creased, and that not only results in the roof sheathing being of an unattractive appearance but also results in the flexible web being overstretched in the region of the folds or therebeside, so that the fixing may become slack and that may possibly result in damage to the roof sheathing.

The invention is therefore based on the problem of improving the above-defined securing arrangement in such a way as to eliminate the disadvantageous formation of folds and damage to the flexible web and also to prevent the spring ring from slipping out of position, while using simple means to achieve an even higher degree of stability in the fixing action.

According to the invention, this problem is solved in that the outer securing member comprises, as one piece, a plate-shaped resilient spring plate which is at least partially encased by an elastomer or plastomer material, and a clamp means which is enclosed on all sides by an elastomer or plastomer material, forming a resiliently yielding cushion means arranged in relation to the flexible web. The material used here may be the same material as the material of the flexible web, preferably elastomer, in particular rubber, for the roof sheathings and for the associated securing member. Therefore, the outer securing member comprises on the one hand the resilient spring plate and on the other hand the clamp means. The resilient spring plate advantageously provides that the wind forces acting on the arrangement from the exterior cannot act on the clamping or holding point where the water-impervious flexible web is secured to the walling means, but are carried at the outer periphery of the spring plate. This arrangement does not constitute a rigid structure, in respect of which the wind forces could possibly cause damage to the flexible web, but instead the spring plate is resilient and can distribute any pressures which may possibly be caused by wind forces.

Damage to the flexible web is also advantageously eliminated by the resiliently yielding cushion means which can be easily and practically produced by enclosure of the clamp means on all sides. While the clamp means is enclosed by the elastomer or plastomer material on all sides, under some circumstances it is sufficient for the spring plate to be only partially encased by the elastomer or plastomer material. In a particularly preferred embodiment however, the resilient spring plate is completely enclosed so that the outer securing member represents a virtually completely enclosed component.

The resiliently yielding cushion means which is formed by the enclosure of the clamp means also represents a particularly strong way of holding the flexible web in the undercut configuration of the inner holder member. In addition, the cushion means engages, with the possibility of high resilient forces, around the preferably annular clamp means and the inner edge, which is arranged adjacent thereto, of the resilient spring plate. The inner edge of the spring plate and also the entire plate-shaped securing member may in fact be deformed so as to deviate to a greater or lesser extent from a geometrically precise circular form, thus producing triangular, quadrangular or polygonal openings (the same also applies in regard to the outer contour of the outer securing member). A round configuration is preferred however and is more advantageous from the production point of view, for which reason references will be made to inside diameter and outside diameter, for the purposes of describing the invention.

Due to the spring force of the resilient spring plate which comprises metal and which seeks to return to its original position after the securing operation, thereby increasing the height of the frustoconical portion, the pressed cushion means is urged into the undercut configuration of the holder member, thereby ensuring a reliable securing action which is operative to hold the web over a long period of time.

In accordance with the invention, it is preferable for the resilient spring plate to comprise metal and to be an annular component. By virtue of this arrangement, the resilient spring plate can be produced at low cost and surrounds the clamp means in annular form and assists the spring force thereof for fixing the flexible web on the holder member which is secured to the respective walling means to be sealed off.

In accordance with the invention, it is also desirable for the resilient spring plate to have slots which project radially inwardly from its outer periphery. The above-mentioned plate-like configuration of the clamp ring and thus the resilient spring plate represents a frustoconical configuration. In this arrangement, the inside diameter of the annular resilient spring plate is in practice the middle lower portion of the plate member, from which the annular spring plate flares outwardly in a conical configuration. It will be appreciated that a frustoconical configuration of this kind develops resilient forces in a particularly advantageous manner, when the spring plate which is enclosed over its entire surface by the plastomer or elastomer material, for example rubber, is compressed in the axial direction. However, the same effect occurs when securing the flexible web; for the outer securing member is pressed onto the flexible web which is laid over the holder member, in such a way that the preferably annular clamp means is slipped over the side bead of the holder member towards the walling means, by being slightly spread apart, and can thus be engaged into the undercut portion. The arrangement of the outer securing member in accordance with the invention is such that, in the secured condition, the resilient spring plate, that is to say, the frustoconical portion formed therby, is smaller in height than in the unstressed condition. This compression effect in respect of the frustoconical configuration of the spring plate in the direction of the axis thereof is facilitated by the radial slots which, by spreading open, permit the outside diameter of the spring plate to be enlarged.

In another advantageous aspect of the invention, the outer securing member is provided, adjacent the outer periphery thereof, with a thin annular lip which projects inwardly at an inclined angle and away from the bottom portion of the plate member. If the flexible web is laid for example as the roof sheathing on a flat roof, then it will be appreciated that this is an uneven surface, due to the nature of the building structure. In accordance with the invention, the annular lip provides a stress compensation effect, when dealing with uneven surfaces on which the web has to be laid. In other words, when dealing with uneven surfaces which cause deformation or an increase in the outside diameter of the spring plate, the annular lip prevents the flexible web from being stressed. The flexible web is therefore no longer warped or distorted on one side, and is therefore less likely to suffer from damage. In addition, when installing the flexible web on the walling means in question, the annular lip reduces the frictional force between the outer securing member and the flexible web. The annular lip therefore represents what might be called an incorporated rolling means. Due to the uneven nature of the surface being bridged over in this way by means of the annular lip, the arrangement occasionally provides the further advantage that this forms a defined support means for the outer securing member.

In another advantageous aspect of the invention, the outer securing member has a protective cap of elastomer or plastomer material in the region of the clamp means. The protective cap may be for example moulded on or disposed in some other way on the encasing material of the outer securing member. The cap provides a higher level of mechanical protection. It is particularly desirable for the protective cap to be arranged at a certain distance from the flexible web, in the laid condition thereof, thereby producing cushion-like protective surfaces, particularly where the flexible web is pulled over the holder member and stressed. In that case, in that part of the web which is generally more severely curved, the protective cap prevents the web being hit by hail or other mechanical impacts. It will be appreciated that a flexible web is more likely to suffer from damage due to hard impacts thereagainst, when the flexible web is in a stressed condition than when it is in a non-stretched condition. Therefore, the provision of the protective cap is useful particularly in the region of the side bead over the annular undercut portion of the holder member.

In a particularly preferred embodiment, the clamp means is an open metal spring ring. In fact, from the point of view of the configuration of the ring, this is a spring ring of the known kind referred to above. In accordance with the invention however, the metal spring ring is enclosed on all sides by the plastomer or elastomer material and also forms one piece with the resilient spring plate which is at least partially encased. The open spring ring is therefore no longer slid over the inner holder member as a separate wire member, but in conjunction with the resilient spring plate, that is to say therefore as the outer securing member, in order in that way effectively to clamp the flexible web firmly between the two components. By encasing the spring ring by the enclosure means of elastomer or plastomer material, the influences of temperature and other weather phenomena are also reduced, while bending open of the spring ring alone is no longer possible for the reason that the enclosure means which encases the spring ring on all sides, in the form of a cushion means, itself has a resilient force which seeks to hold the spring ring together in its original shape.

In another embodiment, the clamp means is a metal wire which is permanently deformable by twisting on one or both sides. The metal wire is also encased on all sides and the two ends of the metal wire preferably project at one side, or optionally or in the other embodiment, at both sides, in such a way that the metal wire can be deformed, that is to say, can be twisted as in the case of a bag closure member.

Another embodiment of the clamp means is an open spiral spring. For the purposes of fitting the spring, the spring is expanded but, after having been slipped over the side bead, pulls back into the annular undercut configuration, thereby producing a clamping effect. In accordance with the invention, it is also possible for the clamp means to be a metal member which is permanently deformable in the manner of a hose clip. With this arrangement, assembly of the device is particularly simple because for example it is only necessary to deform the wire by pliers or pincers, in order to produce the known holding effect produced by hose clips.

Another preferred embodiment of the invention is characterised in that the resilient spring plate is provided, in the region of its hole, with a permanently deformable upstanding collar portion, thereby forming so-to-speak a kind of crown cork closure.

The holder member is secured to the roof or to the wall structure by screws. When wind loadings occur, dynamic loadings (alternation of stresses) are produced, which, in the known designs, act on the screws by way of the holder member, and can cause the screws to slacken in the course of time. If the screw, as it slackens, comes out of the surface into which it is screwed, it can cause the flexible web to be perforated.

By virtue of the features of the invention, when fitting the outer securing member, an additional traction or tensile force is applied to the holder member or screw means thereof, as a result of the spring force of the securing member. Fluctuating forces which occur as a result of wind loading are now advantageously carried by the outer securing member in such a way that the initial stress of the fixing screw does not fall below the required minimum and the screw cannot become slack.

A particularly preferred embodiment in accordance with the invention is further characterised in that the open spring ring is arranged in the resiliently yielding cushion means of the elastomer or plastomer material and has two extension portions which project substantially radially at a spacing from each other in the peripheral direction of the cushion means, one of the extension portions being adapted to be engaged into the other. In the uninstalled condition, the two extension portions which project out of the elastomer or plastomer material in the upper region of the outer securing member are arranged at a small distance from each other so that, in the assembly operation, the open metal spring ring can be pushed over the side bead of the holder member, together with the flexible web, with the above-mentioned distance between the two projecting extension portions possibly being temporarily increased for that purpose. Due to the resiliency of the arrangement, the distance between the extension portions then decreases, and can also be further reduced by one extension portion being engaged into the other. For example, a second extension portion is of such a form that it is taken around the first extension portion and latched thereto. When this operation is performed, the distance between the two extension portions which project out of the cushion means is reduced so that in this way the open metal spring ring is contracted to a somewhat greater degree and thus the entire fixing of the flexible web on the wall or flat roof is firmly anchored to the holder member.

In accordance with the invention, particularly advantageous features to permit one extension portion to be engaged into the other, in the above-indicated manner, provide that the first extension portion of the metal spring ring is substantially straight and, at a spacing from the outer periphery of the cushion means, the second extension portion is bent round approximately in the peripheral direction, extending towards the first extension portion over a length which is less than the spacing between the two extension portions, and is then bent back again at the end in a U-shape. The U-shape bent portion permits the first substantially straight extension portion to be easily engaged around by the second extension portion, thereby making it possible to achieve the above-described desired effect with simple means, in a very reliable manner, and with a practical mode of assembly.

In this arrangement, it is also advantageous, in accordance with the invention, for the U-shaped bent portion at the end of the second extension portion to have an end portion which is once again bent radially outwardly transversely with respect to the peripheral direction and parallel to the first extension portion. The length of that end portion then finally terminates approximately at the same level as the first straight extension portion. The portion of the extension portion which is bent round in a transverse direction and which extends in the peripheral direction of the cushion means is then disposed, as viewed in the radial direction, substantially between the point of egress and the end of the first straight extension portion. In other words, the radially outwardly projecting straight end portion provides a good handle arrangement for laying the second extension portion around the first extension portion, for example using a simple pair of pliers or pincers, so that the two extension portions can interengage.

Figure 2:
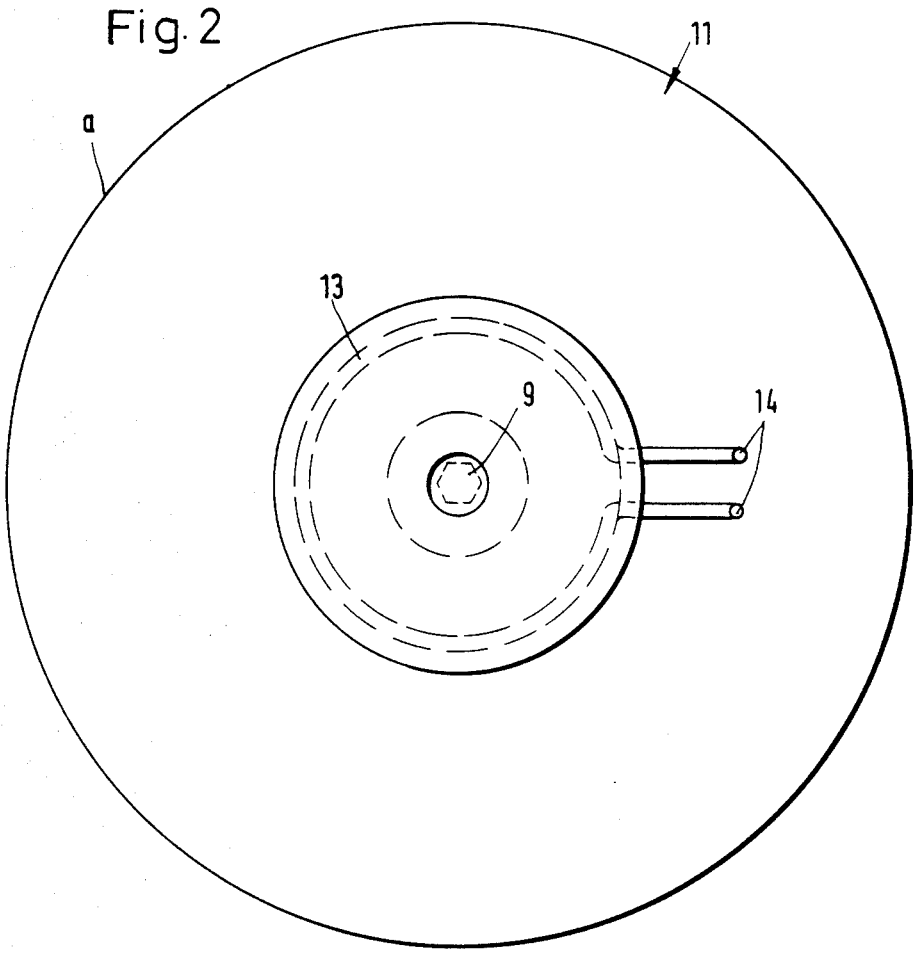
Figure 3:
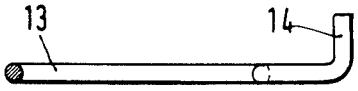
Figure 4:
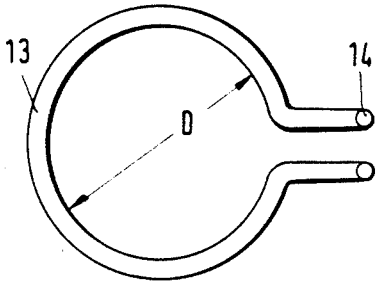
Figure 5:
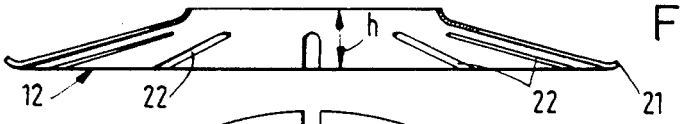
Figure 6:
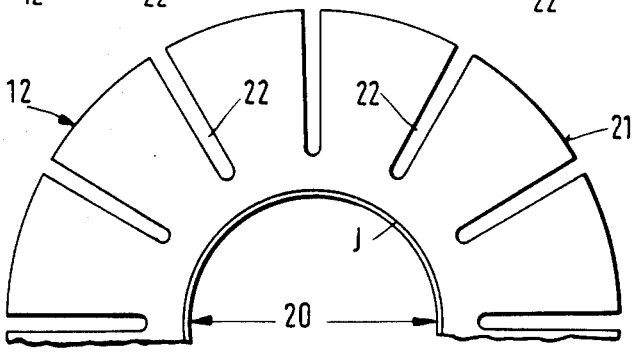
Figure 7:
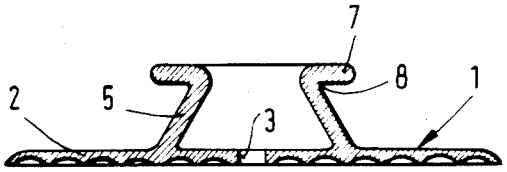
Figure 8:
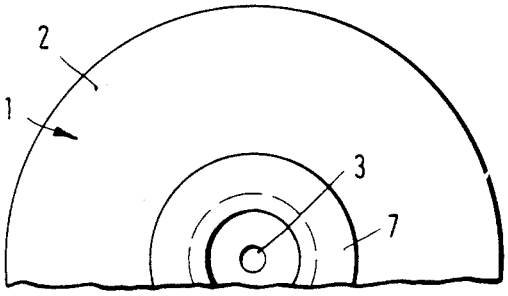
Figure 9:
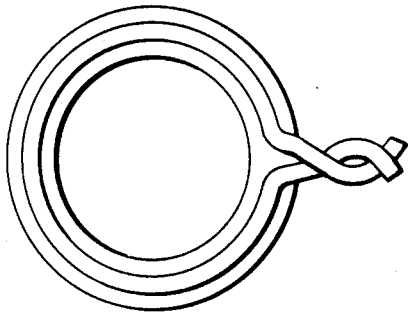
Figure 10:
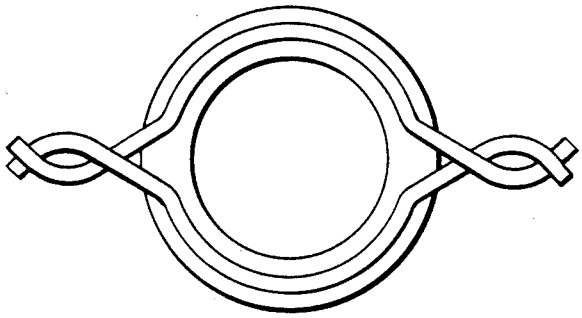
Figure 11:
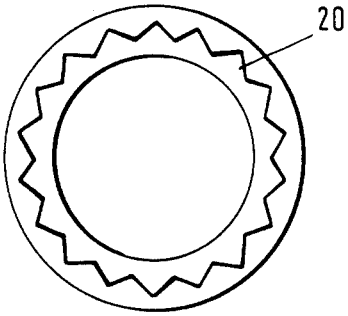
Figure 12:
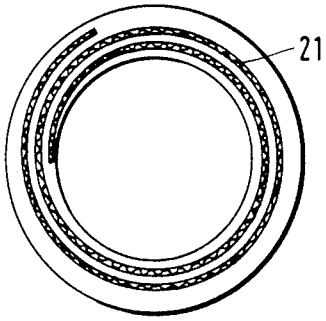
Figure 13:
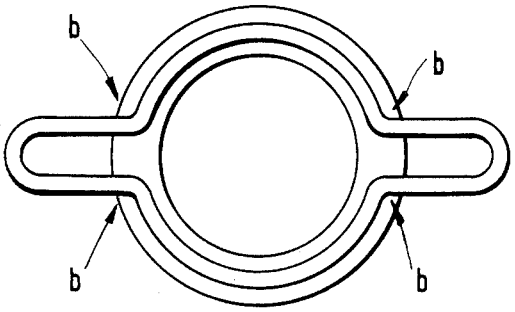
Figure 14:
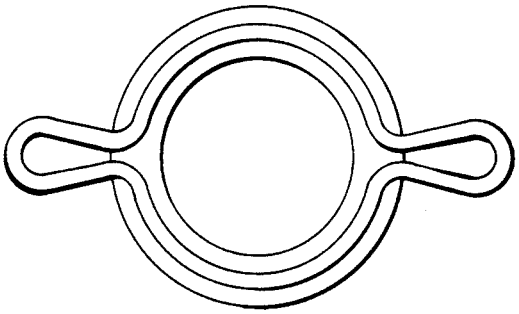
Figure 15:
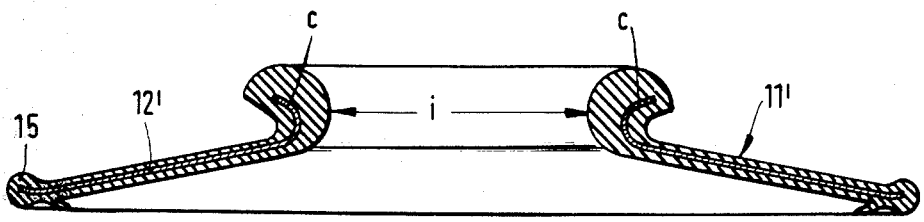
Figure 16:
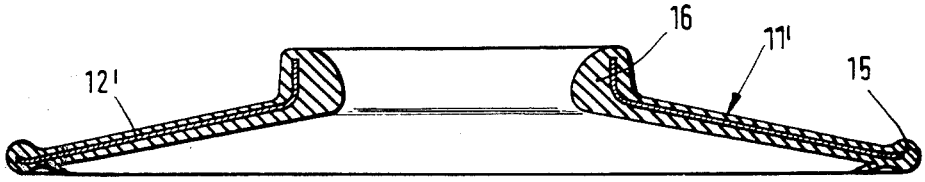
Figure 17:
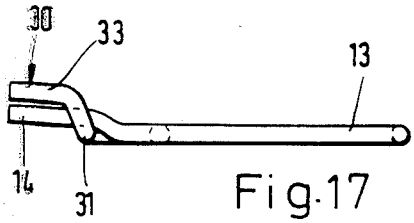
Figure 19:
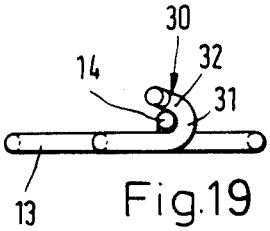
Figure 18:
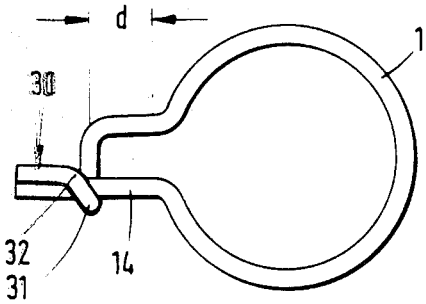

Further features, advantages and possible uses of the present invention will be apparent from the following description of preferred embodiments in connection with the drawings in which:

FIG. 1 shows a view in cross-section of the assembled securing arrangement with the flexible web and the walling means to be sealed off, FIG. 2 shows a plan view of the securing arrangement of FIG. 1 from above looking onto the walling means, FIG. 3 shows a side view of the open spring ring, FIG. 4 shows a plan view of the open spring ring, FIG. 5 shows a side view of the resilient spring plate, FIG. 6 shows one half, illustrated in brokenaway form, of the resilient spring plate, FIG. 7 shows a cross-sectional view of the holder member, FIG. 8 shows a plan view from above of the holder member, FIG. 9 shows a plan view of a clamp means in the form of a metal wire which is permanently deformable at one side by twisting, FIG. 10 shows the same view except that the metal wire has twistable ends on both sides, FIG. 11 shows a diagrammatic view of a clamp means in the form of a tension spring which is closed in itself and bent to form the ring, FIG. 12 shows a clamp means in the form of an open spiral spring which is disposed in a ring form in the region of the cushion means, FIG. 13 shows a clamp means in the nature of a hose clip with a permanently deformable metal portion in the non-clamping condition, FIG. 14 shows the same kind of clamp means in the clamping condition, FIG. 15 shows a resilient spring plate with upstanding collar portion in the region of the central hole therein, in the manner of a crown cork closure, in a non-clamping condition, FIG. 16 shows the same view as FIG. 15 but in the clamping condition, FIG. 17 shows a similar side view of the open spring ring as shown in FIG. 3, but in a different embodiment, FIG. 18 shows a plan view of the spring ring in a view corresponding to FIG. 4, but in the embodiment shown in FIG. 17, FIG. 19 shows a plan view of the ends of the two extension portions of the spring ring, looking from left to right as viewing in FIGS. 17 and 18, with the spring ring of the design shown in FIGS. 17 to 19 being illustrated in an engaged condition, FIG. 20 shows a cross-sectional view of the assembled securing arrangement with the flexible web and the walling means to be sealed off, but with a different embodiment of the holding means, the outer securing member and in particular the spring ring which is of the kind shown in FIGS. 17 to 19, and FIG. 21 shows a plan view of the securing arrangement of FIG. 20, looking downwardly onto the walling means.

The holder member 1 comprises a circular disc 2 having a central securing hole 3 and depression portions 4 which are impressed from below. An annular collar portion 5 adjoins the disc 2 in an upward direction and comprises a frustoconical wall portion which projects substantially perpendicularly from the walling means 6 (see FIG. 1). At its lower end, the frustoconical wall portion is connected to the disc 2 while at its upper end it has a side bead 7 for forming an annular undercut configuration 8.

As shown in FIG. 1, the holder member 1 is mounted to the walling means 6, for example a flat roof, by means of the screw 9. The water-impervious, flexible web 10 lies on the holder member 1 and is fixedly clamped by the outer securing member 11, by means of the undercut configuration 8.

The outer securing member 11 is in the form of a plate member with an open bottom, or a frustoconical portion, being formed substantially by the shape of the resilient spring plate 12 shown in FIGS. 5 and 6. The outer securing member 11 has the open spring ring 13 with extension portions 14 at its free ends and the frustoconical resilient spring plate 12, which are both provided with an encasing means having a bead portion 15 at the outer periphery a and a resiliently yielding cushion means 16 at the inner periphery i. FIG. 1 also shows that the outer securing member 11 is provided, adjacent its outer periphery a, with a thin annular lip 17 which extends at an inclined angle inwardly and away from the bottom of the plate member and which faces towards the centre, around the lip 17, as can also be seen in FIG. 1. An annular protective cap 17*a* is formed or moulded on the cushion means 16 and covers, at a spacing, the hole formed by the inside diameter i, except for a small central opening 16*a*. The shape of the securing member 11 is essentially defined by the annular resilient metal spring plate 12 which will be described with reference to FIGS. 5 and 6. The drawing shows that the inside diameter 20 of the spring plate 12 is approximately equal to the diameter D of the spring ring 13 (see FIGS. 4 and 6). Slots 22 extend radially inwardly from the outer periphery 21 of the spring plate 12 and are distributed uniformly around the periphery thereof. It will be appreciated that the height h of the frustoconical spring plate 12 can be reduced in the assembly operation by compressing the securing member 11 from the outside downwardly towards the walling means 6, while, when that is done, the outer periphery 21 of the spring plate 12 is enlarged, with the slots 22 being slightly increased in width.

The assembled condition of the securing arrangement as shown in FIG. 1 shows that the holder member 1 projects with its side bead 7 through the inner opening formed within the inside diameter i of the outer securing member 11, while the flexible web 10 is clamped between the side bead 7 and the cushion means 16, with assistance by the inner periphery i of the spring plate 12, also by the directional force of the spring ring 13 and additionally by the resilient force in the cushion means 16, the web 10 being clamped firmly, reliably and without undesirable folding occurring, because the novel securing arrangement permits the pressure to be distributed over a large area.

FIGS. 9 and 10 show a clamp means in which, instead of the open spring ring 13, permanently deformable ends project out sideways at one side (FIG. 9) or both sides (FIG. 10), in the manner of a bag closure clip. The deformable ends can be permanently twisted, as when sealing a bag. A comparatively soft steel wire will preferably be used for this arrangement.

In the embodiment shown in FIGS. 11 and 12, a clamp means is used, comprising a tension spring 20 which is closed in itself and bent to form a ring (see FIG. 11) or an open clock spring (FIG. 12). This kind of clamp means is fitted by a spreading operation, by fitting thereto a spreading tool, expanding the cushion region provided with the respective spring, pushing it over the side bead 7, and then removing the spreading tool.

FIGS. 13 and 14 show a clamp means in which, in the manner of a hose clip, a ring of wire or sheet metal, preferably V2A steel, is used and also permanently deformed. The configuration shown in FIG. 13 in plan view, which has not yet been deformed is a metal member which is bent into a circular configuration and which has additional loops or lug portions at two diametrically opposite ends of the circle. As shown in the drawings, the metal member can preferably be bent in an endless configuration in the above-described manner. After the outer securing member has been slipped over the side bead 7 of the holder member 1, the metal member shown in FIG. 13 is pressed together at the points indicated by b in such a way as to give the configuration shown in plan view in FIG. 14. The fixing is made and the desired clamping effect is produced in this manner.

Another kind of closure in the nature of a crown cork closure is shown in FIGS. 15 and 16. FIGS. 15 and 16 show the manner in which the resilient spring plate 12' which in this case is completely encased by an elastomer, forming the outer securing member 11', has an outwardly projecting collar portion c in the region of the inner periphery i. This increases the diameter along the periphery i. After the outer securing member 11' has been fitted over the side bead 7 of the holder member 1, the upstanding collar portion c is raised by means of a suitable tool into the position shown in cross-section in FIG. 16, whereby the diameter at the inner periphery i is reduced. In other words, by reducing that diameter in the desired manner, the resiliently yielding cushion means 16 engages into the annular undercut portion 8 of the holder member 1, thereby again giving the desired clamping effect.

In the embodiments shown in FIGS. 17 to 21, a different kind of spring ring 13 is illustrated, from that described with reference to FIGS. 1 to 4. The holder member 1 is also of a slightly different shape from the embodiment illustrated in particular in FIGS. 1, 7 and 8.

The difference between the new metal spring ring in the last-mentioned embodiment, and the first-mentioned embodiment, essentially lies only in the configuration of the extension portions 14 and 30 which, as in the case of FIGS. 1 to 4, issue from the peripheral surface of the resiliently yielding cushion portion 16, at a spacing c from each other. In other respects, the metal spring ring 13 itself lies within the resiliently yielding cushion means of elastomer or plastomer material, is encased thereby and embedded therein, as in the other embodiments.

However, in contrast to the first-described embodiment, the extension portions 14 and 30 shown in FIGS. 17 to 21 are of a different configuration and are of such a shape that one extension portion, for example the first extension portion 14, can be hooked or engaged into the other or second extension portion 30.

For this purpose, the first extension portion 14 of the ring 13 is substantially straight as can be particularly clearly seen from FIGS. 18, 19 and 21. It will be seen from the view shown in FIG. 20 that it is not necessary to have a precisely geometrically straight configuration in this case, as in FIG. 20 the extension portion 14 is bent somewhat in relation to the point of egress from the cushion means 16, and is extended radially along a different line. It will also be seen from FIGS. 17, 18, 20 and 21 that the ends of the two extension portions terminate substantially at the same distance from the outer periphery of the resilient cushion means 16.

While therefore the first extension portion 14 is substantially straight, the second extension portion 30 is of a different configuration. It should also be noted that the specified distances c and d and the length l are shown in the drawings in respect of a spring ring 13 which has already been put into the engaged condition, while some distances are shown in changed form in the unassembled condition. It should therefore be noted that the distance c is the distance between the two centre lines of the extension portions 14 and 30 along the periphery of the cushion means. Therefore, by the compression effect, the distance c is shown, on the basis of the definition, as being somewhat larger, while in actual fact it has been reduced, in relation to the unstressed condition, by the two extension portions being engaged together.

The second extension portion which is generally denoted by reference numeral 30 in the drawings is bent over at a spacing d from the outer periphery of the cushion means 16, so as to extend over a length l towards the first extension portion 14, as viewed in the peripheral direction of the cushion means 16, that is to say, in the view shown in FIG. 21, the second extension portion has been bent upwardly, in FIG. 18 it has been bent downwardly and in FIG. 17 it has been bent towards the person looking at the drawings. The length l is less than the above-mentioned distance c between the two extension portions 14 and 30 where they issue from the cushion means 16. The second extension portion 30 is bent back again in a U-shape at the end of the above-described length l in such a way as to produce the bent-back portion 32 shown in FIGS. 18 and 19. That portion 32 is the engagement or hooking portion into which the first extension portion 14 is engaged, as shown in FIGS. 17 to 20.

So as to facilitate the hooking engagement action, because in particular two limb portions which extend parallel to each other adjacent to each other can be moved towards each other and twisted around each other by tools, the U-shaped portion 32 is again bent transversely with respect to the peripheral direction, that is to say, facing radially outwardly and extending parallel to the first extension portion 14, thus forming the end portion 33.

I claim:

1. An arrangement for securing a water-impervious, flexible web comprising an elastomer on a walling means to be sealed, in particular a flat roof, comprising a holder member which can be secured to the walling means and which has a projection with an outwardly projecting side bead forming an undercut configuration, and an outer securing member, wherein the web can be clamped fast between the holder member and the outer securing member, characterised in that the outer securing member has as one piece a plate-shaped resilient spring plate which is at least partially encased by an elastomer or plastomer material and a clamp means which is enclosed on all sides by an elastomer or plastomer material, forming a resiliently yielding cushion means arranged in relation to the flexible web.

2. An arrangement according to claim 1 characterised in that the resilient spring plate comprises metal and is annular.

3. An arrangement according to claim 2 characterised in that the resilient spring plate has slots extending radially inwardly from its outer periphery.

4. An arrangement according to claim 1 characterised in that the outer securing member has, adjacent its outer periphery, a thin annular lip which extends at an inclined angle inwardly and away from the base of the plate portion.

5. An arrangement according to claim 4 characterised in that the outer securing member has a protective cap of elastomer or plastomer material in the region of the clamp means.

6. An arrangement according to claim 5 characterised in that the clamp means is an open metal spring ring.

7. An arrangement according to claim 5 characterised in that the clamp means is a metal wire which is permanently deformable by twisting at one or both sides.

8. An arrangement according to claim 5 characterised in that the clamp means is an open spiral spring.

9. An arrangement according to claim 5 characterised in that the clamp means is a metal member which is permanently deformable in the manner of a hose clip.

10. An arrangement according to claim 5 characterised in that the resilient spring plate has a permanently deformable upstanding collar portion in the region of the hole in the spring plate, in the manner of a crown cork closure.

11. An arrangement according to claim 6 characterised in that the open metal spring ring is arranged in the resiliently yielding cushion means of the elastomer or plastomer material and has two extension portions which project substantially radially outwardly at a spacing from each other in the peripheral direction of the cushion means, one of which extension portions can be engaged into the other extension portion.

12. An arrangement according to claim 11 characterised in that the first extension portion of the metal spring ring is substantially straight and the second extension portion is bent over at a spacing from the outer periphery of the cushion means substantially in the peripheral direction, extending towards the first extension portion over a length which is less than the spacing between the two extension portions and is bent back again in a U-shape at the end.

13. An arrangement according to claim 12 characterised in that the portion which is bent back in a U-shape at the end of the second extension portion has an end portion which is bent over again transversely with respect to the peripheral direction and radially outwardly and parallel to the first extension portion.

* * * * *